US011530905B2

(12) United States Patent
Seward

(10) Patent No.: US 11,530,905 B2
(45) Date of Patent: Dec. 20, 2022

(54) ROTATABLE LOCK AND RELEASE MECHANISM

(71) Applicant: Woodward, Inc., Fort Collins, CO (US)

(72) Inventor: Michael Paul Seward, Mount Prospect, IL (US)

(73) Assignee: Woodward, Inc., Fort Collins, CO (US)

( * ) Notice: Subject to any disclaimer, the term of this patent is extended or adjusted under 35 U.S.C. 154(b) by 139 days.

(21) Appl. No.: 17/161,764

(22) Filed: Jan. 29, 2021

(65) Prior Publication Data

US 2022/0244027 A1 Aug. 4, 2022

(51) Int. Cl.
*F42B 10/64* (2006.01)
*F42B 10/14* (2006.01)

(52) U.S. Cl.
CPC ..... *F42B 10/64* (2013.01); *F42B 10/14* (2013.01)

(58) Field of Classification Search
CPC ..... F42B 10/14; F42B 10/62; F42B 10/64; F16C 41/001; F16B 21/165; F16B 2/16; Y10T 403/604; Y10T 403/592; Y10T 403/591; Y10T 403/599; Y10T 279/17752
See application file for complete search history.

(56) References Cited

U.S. PATENT DOCUMENTS 4,643,472 A * 2/1987 Schukei ..... F22B 37/005 403/322.2
5,967,477 A * 10/1999 Walmsley ..... E21B 31/20 248/230.2
6,250,584 B1 * 6/2001 Hsu ..... F42B 10/14 244/3.21
6,352,217 B1 3/2002 Hsu et al.
6,511,100 B1 * 1/2003 Le Clinche ..... F16L 37/23 403/322.2
7,343,720 B2 * 3/2008 Brown ..... B67B 3/2066 53/317
8,089,034 B2 * 1/2012 Hammerquist ..... F42B 10/14 244/3.28
8,148,670 B2 * 4/2012 Tong ..... B64G 1/222 403/91
8,251,606 B2 * 8/2012 Blanchard ..... A01D 34/82 403/322.2

(Continued)

*Primary Examiner* — Joshua J Michener
*Assistant Examiner* — Arfan Y. Sinaki
(74) *Attorney, Agent, or Firm* — McAndrews Held & Malloy, Ltd.

(57) ABSTRACT

A lock and release mechanism includes a primary ring with a first surface and a second surface, each surface including a plurality of channels of varying depths. A secondary ring has first and second surfaces, the first surface including a plurality of channels of varying depths. The channels of the secondary ring are aligned with a portion of an opposing channel of the primary ring. Arranged between the primary and secondary rings are a plurality of low friction elements partially arranged within a channel of the primary ring and partially arranged within an opposing channel of the secondary ring. In order to lock and release the mechanism, the primary ring translates relative to the secondary ring such that the bearing balls move within each channel from a first depth to a second depth greater than the first depth.

18 Claims, 4 Drawing Sheets

(56) References Cited

U.S. PATENT DOCUMENTS

| | | | | |
|---|---|---|---|---|
| 8,686,328 | B2 * | 4/2014 | Bugge | F42B 10/14<br>244/3.27 |
| 10,041,481 | B2 * | 8/2018 | Albright | F03G 7/065 |
| 2008/0116407 | A1 * | 5/2008 | Chang | F16L 37/092<br>251/149.6 |
| 2010/0150648 | A1 * | 6/2010 | Judge | F16B 19/109<br>403/374.1 |
| 2012/0243932 | A1 * | 9/2012 | McCann | F16B 21/165<br>403/287 |

* cited by examiner

ROTATABLE LOCK AND RELEASE MECHANISM

PRIORITY CLAIM/INCORPORATION BY REFERENCE

N/A

FIELD

Certain embodiments of the disclosure relate to moveable control system. More specifically, certain embodiments of the disclosure relate to a fin locking system for missiles to fix the fins against aerodynamic loads, and thereby prevent transmission of these loads through the missile (e.g., through a drive train). In certain embodiments, the moveable control system is configured to activate a mechanical assembly upon receipt of a command signal to disengage the fin locking system (e.g., by rotation of the fin locking system). Advantageously, such fin locking systems are configured to lock into place (to secure the fins in a desired arrangement), release (upon receipt of a command signal or actuation trigger), and can be relocked.

BACKGROUND

When a missile is positioned on an exterior of an aircraft in flight (e.g., on a wing or other launch surface) before launch of the missile, the fin is subjected to high aerodynamic loading. This loading causes the fin to move in the direction of the load and in turn causes the fin shaft to rotate, causing flutter and fatigue failures. Existing fin locking systems have made various attempts to stop the flutter rotation of the fin shaft or the output shaft. However, issues remain despite the various attempts to overcome the undesirable loading.

Further limitations and disadvantages of conventional and traditional approaches will become apparent to one of skill in the art, through comparison of such systems with the present disclosure as set forth in the remainder of the present application with reference to the drawings.

BRIEF SUMMARY

A system and/or method is provided for a fin locking system for missiles with a moveable control system to fix the fins against aerodynamic loads and to disengage the fin locking system by translation of one or more components of the fin locking system.

Advantageously, the fin locking system can be locked, unlocked, and reset. The fin locking system eliminates the need for sensitive, complex, or bulky components common in conventional products, which also simplifies manufacturing and lowers cost. The fin locking system fits in a compact envelope, yet is scalable and configurable for a variety of applications.

These and various other advantages, aspects and novel features of the present disclosure, as well as details of an illustrated embodiment thereof, will be more fully understood from the following description and drawings.

BRIEF DESCRIPTION OF SEVERAL VIEWS OF THE DRAWINGS

The figures are not necessarily to scale. Where appropriate, similar or identical reference numbers are used to refer to similar or identical components.

DETAILED DESCRIPTION

Figure 1A:
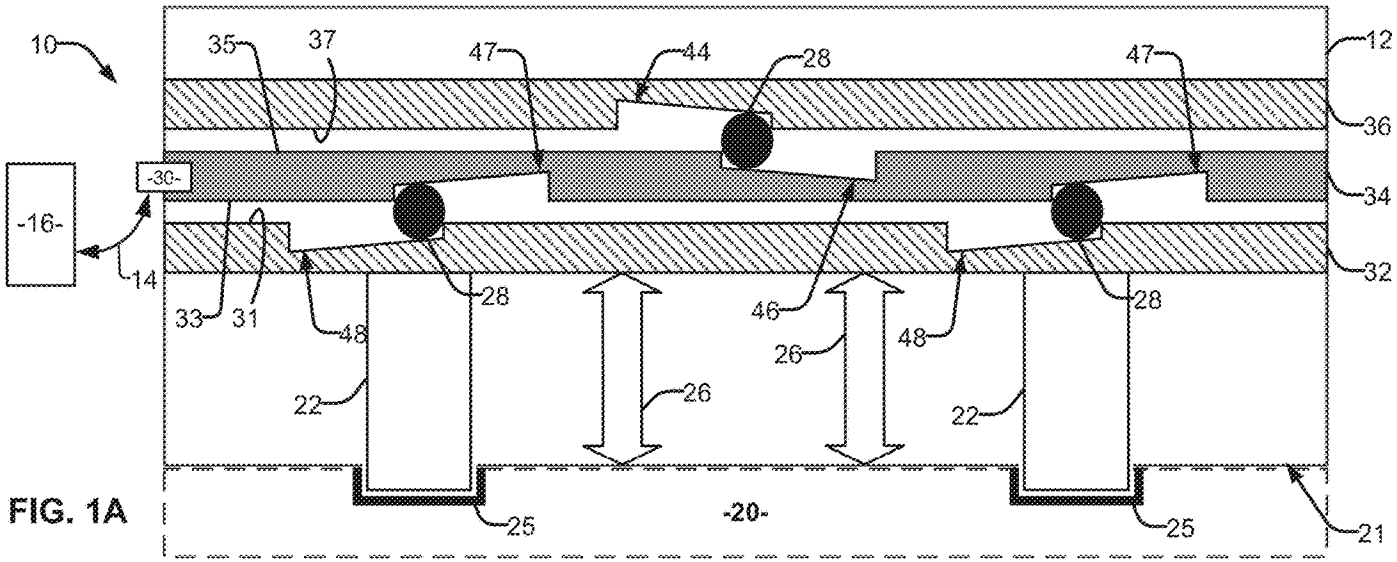
FIG. 1A is a partial cross-sectional view of an example rotatable lock and release mechanism in a locked configuration, in accordance with an example embodiment of the disclosure.

As utilized herein, "and/or" means any one or more of the items in the list joined by "and/or". For example, "x and/or y" means any element of the three-element set {(x), (y), (x, y)}. Similarly, "x, y, and/or z" means any element of the seven-element set {(x), (y), (z), (x, y), (x, z), (y, z), (x, y, z)}. As utilized herein, the term "module" refers to functions that can be implemented in hardware, software, firmware, or any combination of one or more thereof. As utilized herein, the term "exemplary" means serving as a non-limiting example, instance, or illustration.

Certain embodiments of the disclosure relate to a lock and release mechanism. In some examples, the mechanism includes a primary ring or other object with a first surface and a second surface, such that each surface of the primary ring includes a plurality of recessed channels each having a varying depth. A secondary ring or other object has a first surface and a second surface, such that the first surface of the secondary ring includes a plurality of channels each with a varying depth, the plurality of channels of the secondary ring arranged to align with a portion of an opposing channel of the plurality of channels of the primary ring. Arranged between the primary and secondary rings are one or more low friction elements to reduce friction between moving parts, such as a plurality of bearing balls, partially arranged within a channel of the primary ring and partially arranged within an opposing channel of the secondary ring. In order to lock and release the mechanism, the primary ring is configured to translate relative to the secondary ring from a first position where each of the bearings is located along a respective channel at a first depth, to a second position, where each of the bearings is located along the respective channel at a second depth greater than the first depth. Accordingly, the mechanism is in a locked configuration in the first position, and an unlocked or release configuration in the second position. Advantageously, the lock and release mechanism may be reset.

The disclosed systems, methods, and related concepts provide specific improvements and advantages to a variety of systems. In an example application regarding flight control, flight control systems of many and diverse types have been widely utilized. Such systems may generally include a control surface. In the case of a missile or other guided ordinance, the control surface is typically a fin.

In some conventional flight control systems, the control surface (or fin) is connected by a shaft, which may be adapted to be moveable for purposes of flight control. A fin shaft for conventional flight control systems is generally connected through an output drive shaft that is rotated by a connection through an appropriate drive train to a power source.

Missiles and other guided ordinance (i.e. "smart bombs"), utilize control surfaces or fins to steer the vehicle in flight. When the missile is positioned on an exterior of the aircraft in flight (e.g., on a wing or other launch surface), but before launch of the missile, the fin is subjected to high aerodynamic loading. However, inadvertent or unintentional movement of the fins must be mitigated or prevented, as the undesirable loading and/or aerodynamic flutter of the fin in captive carry may cause damage to the fins during handling before flight. In some instances, this loading causes the fin to move in the direction of the load and in turn causes the fin shaft to rotate. This rotational movement is transmitted through the drive train, causing flutter and fatigue failures. Resulting aerodynamic loads on the fins are transferred to the missile itself, which then transfer to the component upon which the missile is mounted (e.g., an aircraft wing), which creates additional strain on the system. Such issues exist even when the fins are in a fixed position, such as by employment of a brake mechanism in an attempt to stop the flutter rotation of the fin shaft or the output shaft. In order to deploy the missile, the fins must be released quickly, properly, and reliably.

There are several existing mechanisms to lock fins in position pre-deployment and then release the fins upon deployment. Each conventional system has drawbacks. In an example conventional system, a pyrotechnic (e.g., squib) actuator is employed to create high pressure gas within a piston to drive an unlocking mechanism in order to deploy a locked fin mechanism. However, the pyrotechnic charge is expensive, and requires the use of a manifold (e.g., distributed manifold network) to distribute force from the charge gas to multiple fin locking pistons to release the fins. This has the disadvantage of being a single use device which cannot be inherently tested. Further, the addition of the pyrotechnic and manifold increases complexity, sensitivity, size, weight, and ultimately cost of the system.

Other conventional techniques employ a brake or latch at a connected motor to lock movement of the motor. This technique may be less expensive, but it allows gear train backlash at the fin, which allows for a small amount of movement. It also results in low stiffness of the fin in the locked state (e.g., during flight, pre-deployment), which, combined with the backlash, can result in flutter.

In response to undesirable aerodynamic loading of the drive train, multiple attempts have been made to provide a lock to eliminate the effects of aerodynamic loading. The majority of locks for such control surfaces (e.g., fins on missiles) have failed for one or more reasons. For instance, some locks are prone to sticking or otherwise failing to release upon command in a substantially frictionless fashion. Some conventional locks are prone to inadvertent unlatching due to vibration during normal operation (e.g., during flight, prior to deployment). Other locking mechanisms are complex and may include a large number of parts, all of which must operate properly to avoid a malfunction. One example system that overcomes many of the identified problems is disclosed in U.S. application Ser. No. 09/419,544, filed Oct. 18, 1999, entitled "Missile Fin Locking Mechanism" (now U.S. Pat. No. 6,250,584), which is incorporated herein by reference. However, all conventional systems continue to experience difficulties in deploying the fin immediately and smoothly upon command (e.g., by retracting the locking pin).

The disclosed fin locking system provides specific advantages over conventional systems. In some examples, the disclosed fin locking mechanism is designed to rotate to disengage by employing an actuator such as a solenoid. Through employment of the rotational mechanism as well as a solenoid actuator, the fin locking mechanism serves to reduce complexity, sensitivity, size and cost. Further, the disclosed fin locking system can be tested and reset. It also allows for the fin shaft to be directly locked, resulting in high stiffness of the fins during flight and eliminating backlash. The fin locking system is compact and relatively simple to manufacture, as machining from wrought bar stock is possible. This small size, reliability in pre- and post-deployment, and ease of manufacture translates to reduced cost.

In some examples, a rotatable lock and release mechanism is disclosed consisting of three rings. A plurality of low friction elements, such as bearing balls, are positioned in helical ramps formed in the rings as channels recessed from a surface of the ring. A plurality of locking pistons, paired with a plurality of locking springs, are configured to extend from the mechanism to mate with a fin lock mechanism (e.g., for a fin or other control surface for a missile). One or more loading devices are arranged to force one or more rings together upon release of the ring(s), such as via a latch or activated via an actuator (e.g., a solenoid).

In the locked configuration, the rings are furthest apart, with the pistons extending from the mechanism. The helical ramps positioned in opposing directions (with regard to the first and second depths of opposing, aligned channels) around a primary or middle ring, such that the reaction force from the springs also produces a torque acting on the middle ring relative to other rings and/or a housing. This torque is reacted by a restraining device, such as a clamp, lock, or other device configured to hold the primary ring against the torque from the reaction force.

The displacement of the rings apart compresses the locking springs between the secondary ring and the locking piston, which mated with the fin lock mechanism, preventing movement. When the restraining device is actuated (e.g., released), the primary ring translates and rotates to move the low friction elements and thereby close the distance between the rings and/or the housing. The pistons are then pulled by the continued translation of the ring and retracted fully, allowing the fin shaft to rotate freely. Advantageously, the mechanism can be reset by providing a torque in the opposite direction on the primary ring, charging the springs as the spacing between the rings increases, until the restraining device captures it again.

Referring now to the figures, FIG. 1A illustrates an example fin lock and release mechanism 10, as disclosed herein. As shown, the mechanism 10 is generally contained within a housing 12. The housing 12 of example FIG. 1A may have a generally circular shape, which facilitates rotational translation between two or more rings, plates, or associated surfaces, as described with reference to the remaining figures. In some examples, translation between opposing surfaces is not limited to rotational movement, and may include linear translation and/or multi-dimensional translation, such that a shape of any housing may change to accommodate movement between surfaces.

A solenoid or other suitable actuator 16 may be used to activate the mechanism 10. As shown, a conduit, lever, spring, pneumatic tube, and/or other actuatable device 14 may connect the actuator 16 with the mechanism 10. For instance, the actuator 16 may be mechanically and/or electronically activated, with forces and/or signals being transmitted through the device 14 to activate (e.g., release) the mechanism.

As shown in FIG. 1A, a plurality of rings are enclosed within the housing 12 of the mechanism 10, including a primary ring 34, a secondary ring 32, and a tertiary ring 36. As shown, a latch or other suitable restraining device 30 is secured to the secondary ring 32, and may be connected to the actuatable device 14.

One or more pistons 22 are oriented toward a surface 21 of the housing 12 facing a fin locking mechanism 20. One or more loading devices 26 are arranged between a surface 21 and the secondary ring 32. For example, loading devices may include one or more of a retraction spring, torsion springs, or a pressurized fluid, as a list of non-limiting examples.

In the examples illustrated in FIGS. 1A to 4B, the low friction elements 28 are shown as bearing balls, although one of ordinary skill in the art would recognize that a variety of low friction elements, with a variety of materials, geometries, and/or arrangements, would be equally applicable to the provided examples.

As shown in FIG. 1A, a plurality of bearing balls (e.g., low friction elements) 28 are arranged between the primary ring 34 and the secondary and/or tertiary rings such that each bearing ball 28 is at least partially arranged within a channel of the primary ring and partially arranged within an opposing channel of the secondary ring.

In a locked configuration shown in FIG. 1A, each of the bearing balls 28 are located along a respective channel at a first depth, which results in a maximum distance between the secondary and primary ring, and/or the secondary and tertiary rings. At this distance, the springs 26 are charged at the first depth, such that the pistons 22 are mated with a corresponding fin locking mechanism, thereby locking the fins in a flight configuration.

Figure 1B:
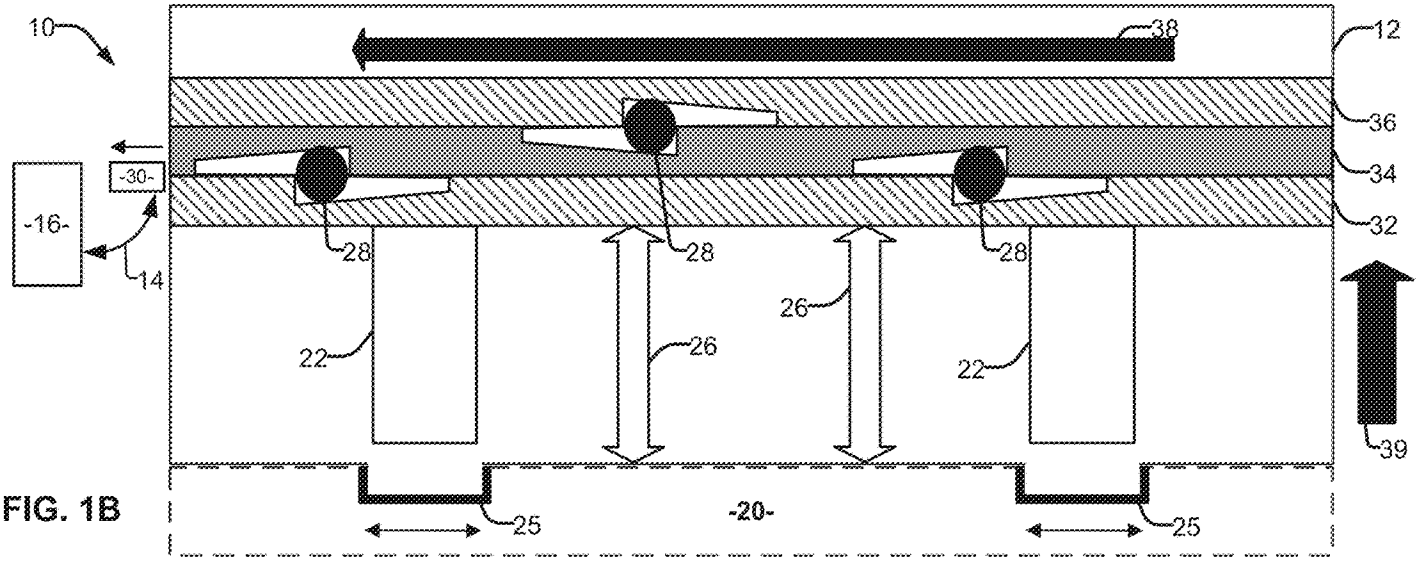
FIG. 1B is a partial cross-sectional view of the example rotatable lock and release mechanism of FIG. 1A in a release configuration, in accordance with an example embodiment of the disclosure.

In a release or unlocked configuration shown in FIG. 1B (e.g., in response to disengagement of the release mechanism or restraining device 30), the primary ring 34 rotates as indicated by arrow 38. As the primary ring 34 rotates, the charged springs 26 are released and force the distance between the secondary ring 32 and primary ring 34 and/or the distance between the primary ring 34 and the tertiary ring to close. At this second distance, the pistons 22 are retracted from the fin locking mechanism, allowing connected fins to move freely. In some examples, activation of the mechanism may remove a locking feature, allowing for movement between elements in a variety of applications.

In some examples, the pistons 22 are fixed to a surface of the secondary ring 32. The pistons 22 are arranged to extend through the housing 12 to mate with the fin locking mechanism 20 in the locked configuration.

In the example of FIG. 1A, the restraining device or latch 30 is engaged with a catch or slot of the primary ring 34. A rotational force can be applied to the primary ring 34, forcing the bearing balls 28 to occupy the first depth within respective channels 44, 46, thereby increasing the distance between rings. This arrangement of the rings from application of the force charges the loading devices 26 (e.g., retraction springs), such that tension exists against the restraining device 30 from the primary ring 34 to rotate (e.g., in direction 38, shown in FIG. 1B).

FIG. 1B illustrates the lock and release mechanism 10 in a release configuration. In response to the restraining device 30 being deactivated to disengage with the catch (e.g., in response to an actuation signal and/or mechanical actuator), the retraction springs 26 force the secondary ring 32 toward the primary ring 34 and/or tertiary rings 36 in direction 39. The force drives the bearing balls 28 to move from the shallow first depth through the recessed channels 44, 46, to the greater second depth. As the bearing balls 28 move, the primary ring 34 rotates (in direction 38) relative to the secondary and tertiary rings, which may be in a fixed position relative to the housing 12. As a result, the secondary ring 32 and/or the primary ring 34 move toward the tertiary ring 36 in the direction 39, thereby decreasing the amount of distance between rings. This movement forces the pistons 22 to retract from the fin locking mechanism 20, allowing the fins to rotate. In some examples, one of two opposing channels has a consistent depth or a depth that varies from end to end different from the variation of the opposing channel.

The locked configuration of FIG. 1A shows the pistons 22 extended such that a pin 23 of the piston mates with a fitting 25 of the fin locking mechanism 20. In other words, the distance between the rings is at a maximum. This is due to the arrangement of the bearing balls 28 occupying the first depth of each respective channel. For example, the tertiary ring 36 includes a plurality of recessed channels 44 within a surface 37 of the ring facing an opposing surface 35 of the primary ring 34. The surface 35 includes a plurality of complementary recessed channels 46, such that a given bearing ball 28 is partially arranged within both channels 44 and 46. Additionally or alternatively, a channel 47 is recessed from surface 33 of the primary ring 34, and opposes a complementary channel 48 recessed from surface 31 of secondary ring 32. Another bearing ball 28 is partially arranged within both channels 47 and 48.

Upon release of the primary ring 34, the bearing balls 28 traverse the respective channels from the first depth to the second depth. In the example of FIG. 1B, the second depth is approximately half the radius of each bearing ball, such that the distance between rings is reduced to a minimum (e.g., opposing ring surfaces may make contact). Due to the force from the retraction springs 26, the movement of the primary and secondary rings toward the tertiary ring 36 is rapid, thereby ensuring release of the fin locking mechanism 20 is completely quickly, thereby releasing the fins to deploy for flight.

Figure 2A:
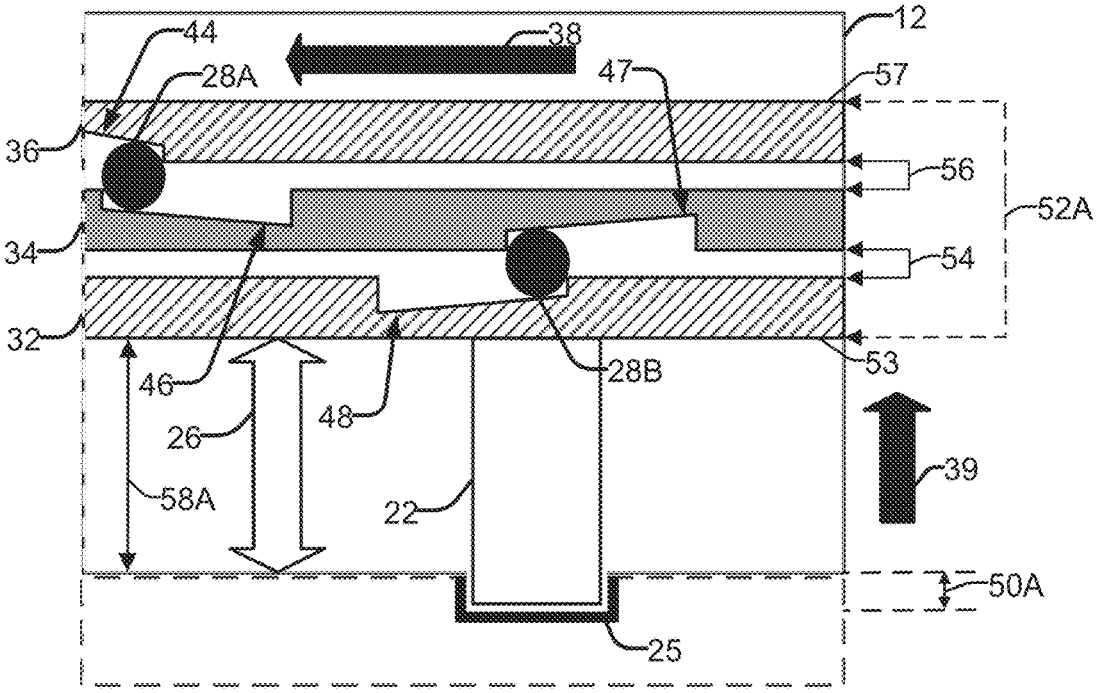
FIG. 2A is a detailed view of the example rotatable lock and release mechanism in a locked configuration of FIG. 1A, in accordance with an example embodiment of the disclosure.
Figure 2B:
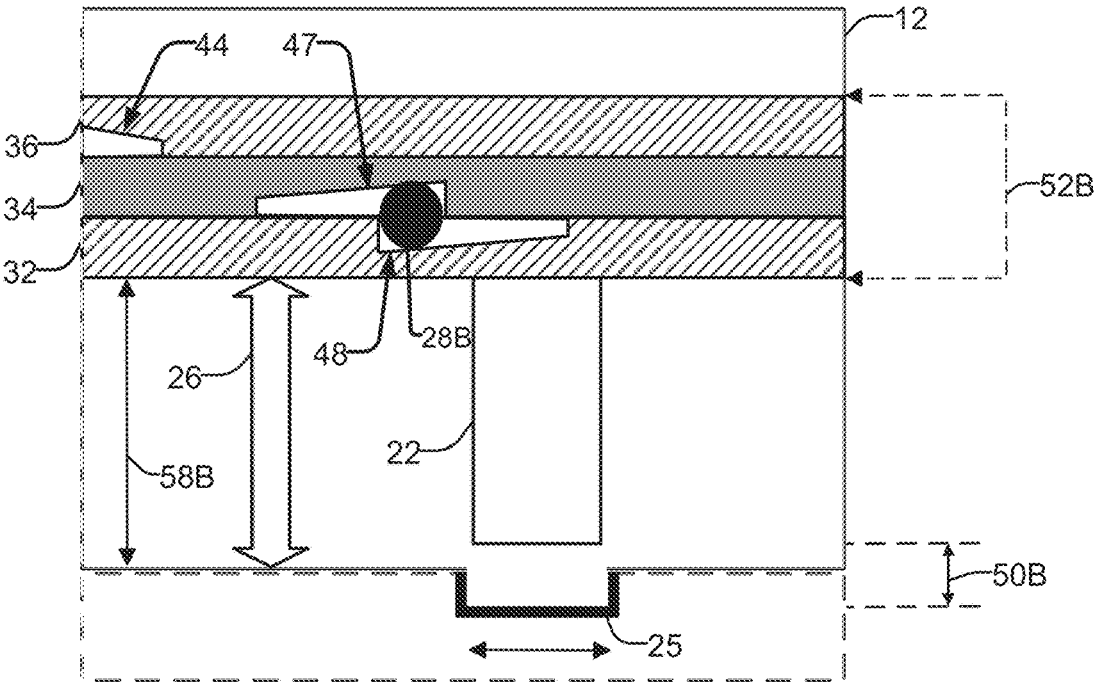
FIG. 2B is a detailed view of the example rotatable lock and release mechanism in the release configuration of FIG. 1B, in accordance with an example embodiment of the disclosure.

FIGS. 2A and 2B illustrate detailed views of the lock and release mechanism 10 in the locked and release configurations shown in FIGS. 1A and 1B, respectively.

In the example of FIG. 2A, a bearing ball 28A occupies the first depth of recessed channels 44 and 46, thereby maintaining a maximum distance 56 between the tertiary ring 36 and the primary ring 34. Bearing ball 28B occupies the first depth of both recessed channels 47 and 48 to maintain a maximum distance 54 between the secondary ring 32 and the primary ring 34. As a result, a distance 52A between a far surface 57 of the tertiary ring 36 and a proximate surface 53 of the secondary ring 32 is at a maximum.

The distance created between rings causes the piston 22 to extend forward a distance 50A beyond the housing 12. Retraction spring 26 is compressed to a distance 58A between the secondary ring 32 and the housing 12, biasing the secondary ring toward the primary and tertiary rings.

Upon release of the restraining device 30, the force from springs 26 forces the primary and secondary rings in direction 39 toward the tertiary ring. The force drives the bearing balls 28A and 28B to move, forcing the primary ring 34 to rotate in direction 38. As a result, the bearing balls 28A and 28B have moved from the first depth to the second depth in each of the respective channels. As shown in FIG. 2B, the movement of the primary ring 34 has forced each of bearing balls 28A and 28B to move in direction 38. In each case, the bearing ball, and by extension the primary ring 34, stops when the bearing ball reaches the first distance of the respective channels.

In the unlocked, release or deployed configuration of FIG. 2B, the distance between surfaces 53 and 57 has narrowed to 52B, and the extension distance has reversed by an amount 50B from the original extension distance. By contrast, release of the retraction spring 26 has caused the spring to extend, increasing the distance between the surface 53 and the housing 12 to 58B. Retraction of the pistons 22 causes them to no longer mate with the fitting 25 of the fin locking mechanism 20, causing the fins to deploy for flight.

In some examples, each channel follows a ramp or linear gradient from the first depth to the second depth. In some examples, the ramp is uneven between ends. In some examples, a channel may include one or more intermediate positions, such as to accommodate ratcheting of the device. This may result from release of a first latch, such that a bearing ball traverses the channel to stop at a first intermediate position, at which another latch arrests translation of the ring. Release of a second latch (or the first latch, holding the ring by a second catch) allows for additional translation of the ring to another intermediate position and/or an end position. The intermediate positions may have a variety of depths selected between the first and second depths.

In some examples, each channel on a surface of a ring is identical. In some examples, a given channel may have a depth, arc, path, gradient, length, width, or a combination thereof that differs from another channel. In some examples, each bearing ball is identical. In some examples, a given bearing ball may have a different radius from another. In some examples, the bearing ball may be substituted for another type of bearing (such as cylindrical rollers, tapered roller bearings, a pin bearing, etc.).

Figure 3A:
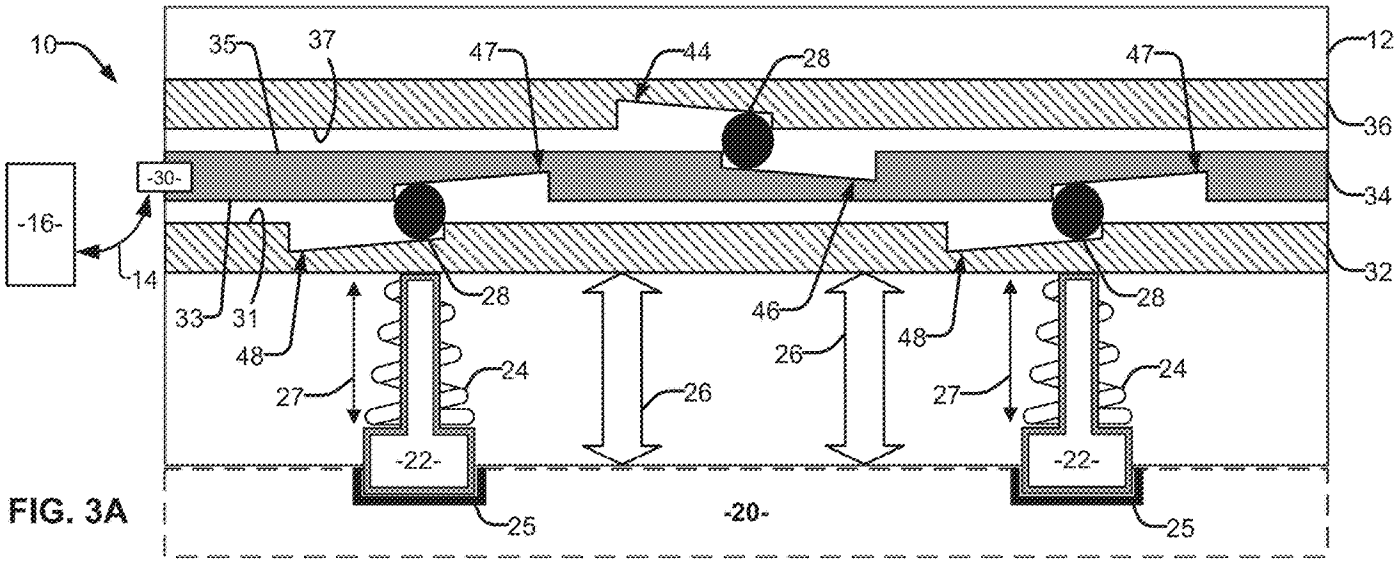
FIG. 3A is a partial cross-sectional view of another example rotatable lock and release mechanism in a locked configuration, in accordance with an example embodiment of the disclosure.
Figure 3B:
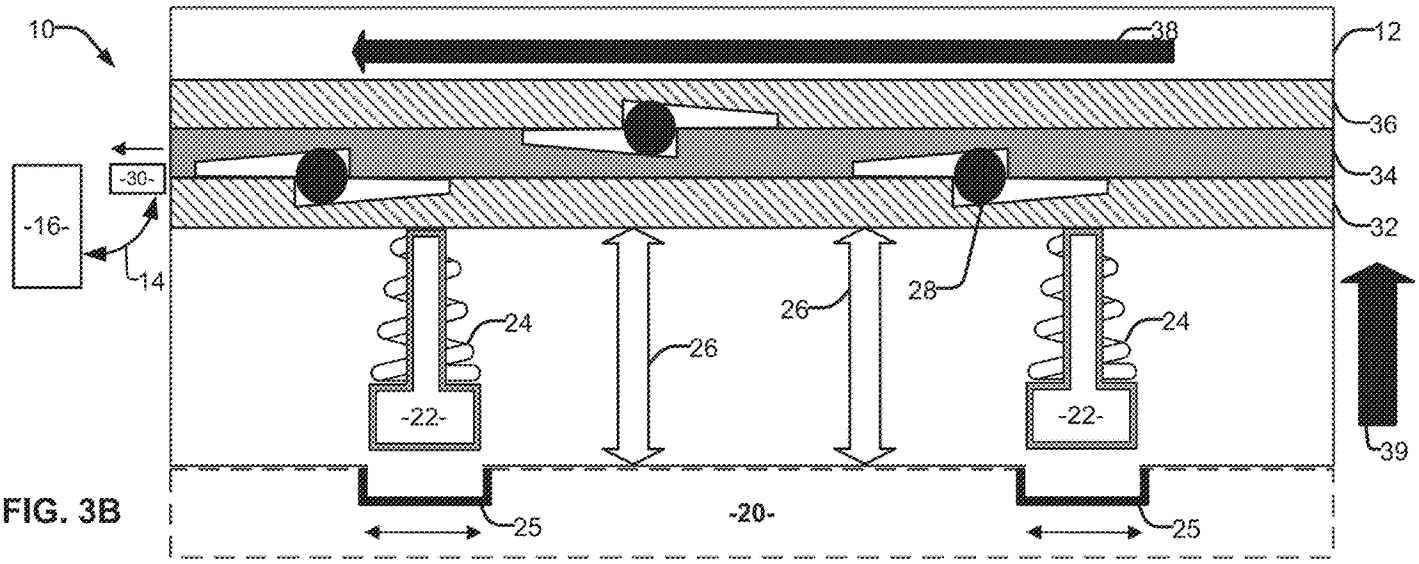
FIG. 3B is a partial cross-sectional view of the other example rotatable lock and release mechanism of FIG. 3A in a release configuration, in accordance with an example embodiment of the disclosure.

Turning now to FIGS. 3A and 3B, a mechanism 10 is provided with the one or more pistons 22 mated with one or more piston springs 24. The piston springs 24 bias the piston 22 (as shown by arrow 27) toward the fin locking mechanism 20, such that piston 22 is engaged with fitting 25 of the fin locking mechanism 20 in the locked configuration. In some examples, the pistons 22 and/or the corresponding piston springs 24 are fixed to a surface of the secondary ring 32.

In the locked configuration shown in FIG. 3A, each of the bearing balls 28 are located along a respective channel at a first depth, which results in a maximum distance between the secondary and primary ring, and/or the secondary and tertiary rings. At this distance, the springs 24 and 26 are charged at the first depth, such that the pistons 22 extend through the housing 12 to mate with a corresponding fin locking mechanism, thereby locking the fins in a flight configuration.

This arrangement of the rings from application of the force charges the piston springs 24, as well as loading devices or, as shown in FIG. 3A, retraction springs 26, such that tension exists against the restraining device 30 from the primary ring 34 to rotate (e.g., in direction 38, shown in FIG. 3B).

In a release or unlocked configuration shown in FIG. 3B (e.g., in response to disengagement of the release mechanism or restraining device 30), the primary ring 34 rotates as indicated by arrow 38. As the primary ring 34 rotates, the charged springs 24 and 26 are released and force the distance between the secondary ring 32 and primary ring 34 and/or the distance between the primary ring 34 and the tertiary ring to close. At this second distance, the pistons 22 are retracted from the fitting 25 of the fin locking mechanism 20, allowing connected fins to move freely.

Upon release of the primary ring 34, the bearing balls 28 traverse the respective channels from the first depth to the second depth. Due to the force from the piston springs 24 and retraction springs 26, the movement of the primary and secondary rings toward the tertiary ring 36 is rapid, thereby ensuring release of the fin locking mechanism 20 is completely quickly, thereby releasing the fins to deploy for flight.

Although each piston 22 of FIGS. 3A and 3B is illustrated as paired with a spring 24 (to aid in rapid deployment of the mechanism upon release), in some examples, one or more pistons are not paired with a spring. In some examples, the pistons may be fixed to the secondary ring, while in some examples the pistons may be configured to move (e.g., extend or retract) relative to the secondary ring.

Figure 4A:
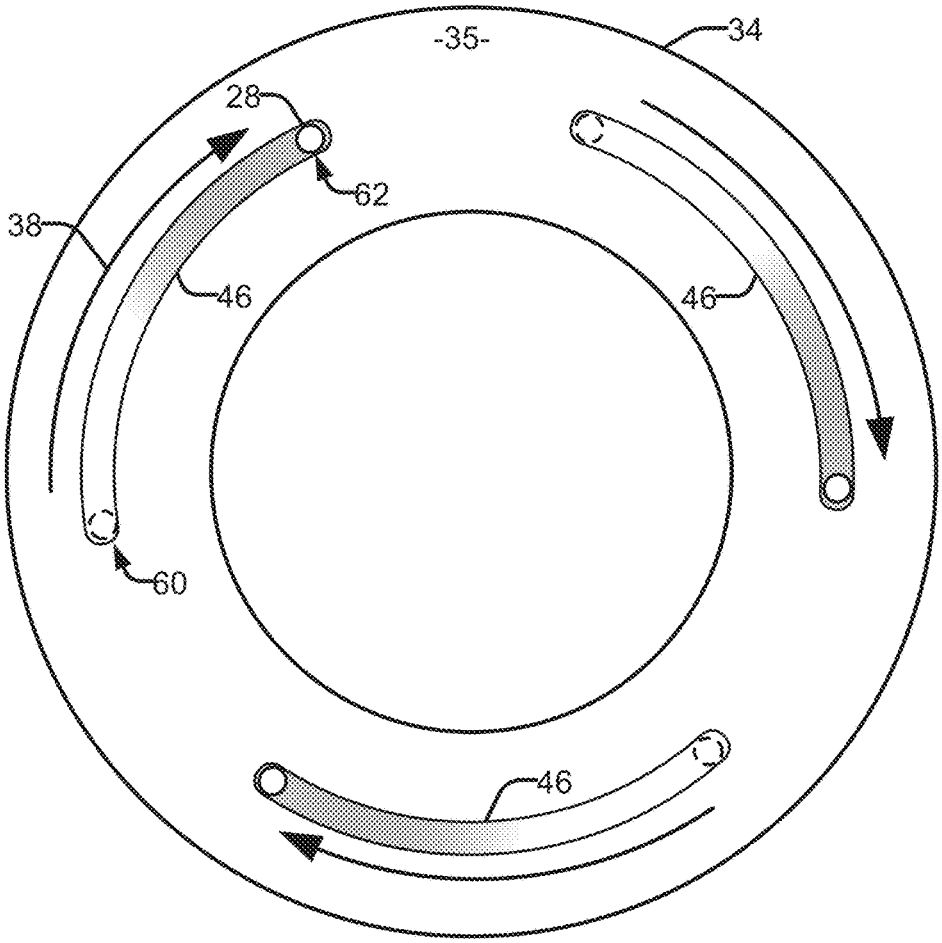
FIG. 4A is a surface view of an example primary ring of a rotatable lock and release mechanism, in accordance with an example embodiment of the disclosure.

In disclosed examples, the mechanism 10 is generally circular. This allows for each channel to follow a generally helical path about a surface of a respective ring. In the example of FIG. 4A, primary ring 34 has three channels 46 recessed from surface 35. Each channel 46 is defined by a first depth 60 at a given end and a second depth 62 at another end of the channel. With reference to FIGS. 1A-3B, the channels of each ring (and a respective channel opposite a given channel) may be arranged at a given radius from a central axis of rotation of the mechanism 10. Thus, as the primary ring 34 rotates in direction 38, as explained herein, each bearing ball traverses each channel in which it is partially arranged until it reaches the second depth 62, arresting the rotation of the primary ring 34.

Figure 4B:
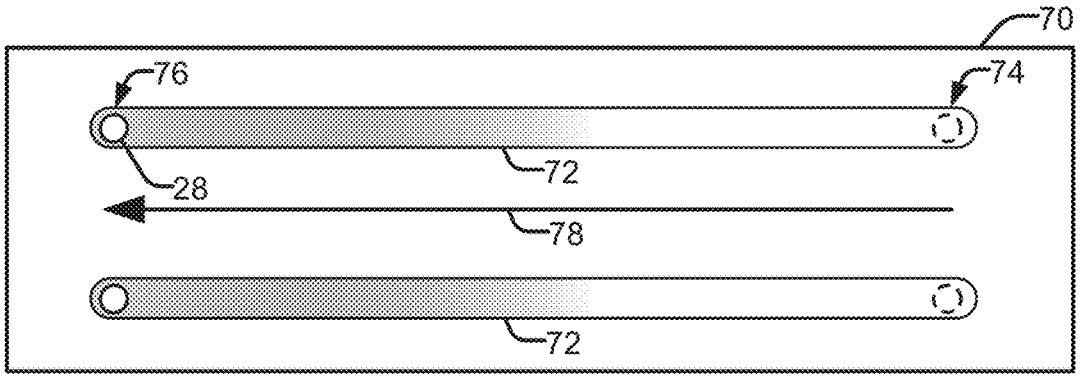
FIG. 4B is a surface view of an example plate for a lock and release mechanism, in accordance with an example embodiment of the disclosure.

Although several examples are illustrated as generally circular and operating by generally rotational movement, the disclosed concepts and techniques can be employed in a variety of geometries and/or applications. In the example of FIG. 4B, a generally rectangular plate 70 includes one or more channels 72, each with a first depth 74 at a given end and a second depth 76 at another end. The plate 70 may be secured in a housing, with one or more bearing balls 28 within the channels 72 between plate 70 and another surface (e.g., of another plate or the housing) in a manner similar to that described with respect to FIGS. 1-4A. For example, plate 70 may be in a locked configuration, with one or more springs providing force against the bearing balls and the other surface. Upon release of the plate 70 from the locked configuration, the bearing balls 28 may traverse the channel 72 from the first depth to the second depth 76, forcing the distance between the plate 70 and the other surface to close.

Although some examples and example figures represent the disclosed lock and release mechanism 10 as employing three rings, in some examples two rings or four or more rings may be employed.

In an example, the housing 12 encloses one or more of the primary or secondary rings, with the primary ring arranged between the secondary ring and the housing. A surface of the primary ring faces an opposing surface of the housing, such as a ridge or extension. Consistent with disclosed examples, one or more bearing balls are arranged between the secondary ring and the primary ring, as well as between the primary ring and the ridge, each bearing ball fitting within a recessed channel of respective opposing surfaces. In some examples, any piston or other locking mechanism is secured directly to a primary ring, which interfaces with the ridge, as disclosed herein. As the primary ring is released, it rotates relative to the housing, casing the locking mechanism to move, as disclosed herein.

As the retraction springs force the secondary ring toward the primary ring, the bearing balls traverse channels between both the secondary ring and the primary ring, and/or the primary ring and the ridge.

In some examples, the lock and release mechanism includes two or more rings configured to rotate, each in a manner similar to that of the primary ring 34 disclosed herein. In some examples, a single latch releases each rotating ring. In some examples, each rotating ring has a dedicated latch. In some examples, one or more of the rotating rings is locked at multiple locations around the ring.

In some examples, each rotating ring may rotate at the same arc and/or to the same extent upon release. In some examples, each rotating ring may rotate along a different arc and/or to a different extent.

In some examples, the restraining device 30 is mounted, secured or otherwise integrated with a fixed surface (such as the tertiary ring 36 and/or the housing 12), and the catch is mounted, secured or otherwise integrated with the movable primary ring 34. In some examples, the latch is mounted, secured or otherwise integrated with the movable primary ring 34, and the catch is mounted, secured or otherwise integrated with the fixed surface.

In disclosed examples, the lock and release mechanism is configured to secure and deploy one or more fins of a missile. For example, the plurality of locking pins 23 may mate with a fitting 25 of a fin lock mechanism 20 for the one or more fins. The fins are adapted to maintain a low profile during flight (e.g., while fixed to an aircraft, in the lock configuration), and to extend outwardly away from an outer surface of the missile and upon deployment (e.g., in the release configuration). The signals may come from the actuator 16 (e.g., a solenoid) which may be controlled by an aircraft pilot, remote pilot, or autopilot in preparation for launch of the missile.

At the desired time of launch the appropriate control signal from the controller would be applied to the actuator 16, releasing the restraining device 30 (e.g., latch) from engagement with the primary ring 34. When the release command is received and the actuator disengages the restraining device 40, the piston springs 24 and retraction springs 26 will propel the pistons 22 from engagement with the fin locking mechanism 20, causing the fins to deploy.

With reference to the several figures, multiple advantages are achieved through the innovative lock and release mechanism disclosed herein. For example, a compact size is achieved through the use of the mechanism to activate with and disengage with a fin locking system, such as mounted on a shaft of a missile or other guided ordinance. Further, one or more actuators are to activate or disengage the lock and release mechanism in order to allow one or more pistons to rapidly retract, thereby providing quick, reliable activation of the fins in a compact and simple platform.

This particular design approach also avoids the use of pyrotechnics required to rapidly and reliably release one or more control surfaces or fins, compared to conventional ways of activating the fins as described above. The compact size of this design leads to other advantages, for example, its compact envelope and relatively lightness provides significant advantages for use in flight, where size and weight considerations are important. Further, although described by particular examples, the concepts and operating principles are applicable to a variety of purposes and industries where rapid disengagement of a lock or other device is desired.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment disclosed, but that the present disclosure will include all embodiments falling within the scope of the appended claims.

What is claimed is:

1. A lock and release mechanism comprising:

a primary ring with a first surface and a second surface, wherein each surface of the primary ring includes a plurality of channels each channel having a varying depth;

a secondary ring with a first surface and a second surface, wherein the first surface of the secondary ring includes a plurality of channels each with a varying depth, the plurality of channels of the secondary ring arranged to align with a portion of an opposing channel of the plurality of channels of the primary ring; and a plurality of low friction elements arranged between the primary and secondary rings, each low friction element partially arranged within a channel of the primary ring and partially arranged within an opposing channel of the secondary ring, wherein the primary ring is configured to translate relative to the secondary ring from a first position, where each of the low friction elements is located along a respective channel at a first depth, to a second position, where each of the low friction elements is located along the respective channel at a second depth greater than the first depth.

2. The lock and release mechanism of claim 1, wherein the arrangement of first and second depths within opposing channels is reversed, such that a first distance between the primary and secondary rings at the first position is greater than a second distance between the primary and secondary rings at the second position.

3. The lock and release mechanism of claim 1, wherein one or more of the plurality of low friction elements is a bearing ball, the second depth of the one or more channels corresponds to a depth up to a radius of the bearing ball.

4. The lock and release mechanism of claim 1, wherein each channel follows a generally helical path about the respective ring at a given radius from a central axis of rotation.

5. The lock and release mechanism of claim 1, further comprising one or more pistons mounted to the secondary ring.

6. The lock and release mechanism of claim 5, wherein the one or more pistons are configured to engage with a locking mechanism in the second position.

7. The lock and release mechanism of claim 1, further comprising one or more loading devices configured to bias the secondary ring toward the primary ring.

8. The lock and release mechanism of claim 7, wherein the one or more loading devices includes one or more retraction springs, the mechanism further comprising a latch to engage with the primary ring to secure the primary ring in the first position, the first position corresponding to the retraction springs being loaded against the secondary ring.

9. The lock and release mechanism of claim 8, wherein the latch is further configured to disengage with the primary ring allowing the primary ring to translate from the first position to the second position in response to the one or more retraction springs forcing the secondary ring towards the primary ring.

10. The lock and release mechanism of claim 9, further comprising a solenoid actuator, wherein the actuator is configured to release the latch upon activation of the actuator.

11. The lock and release mechanism of claim 1, further comprising a tertiary ring with a first surface and a second surface, wherein the first surface of the tertiary ring includes a plurality of channels with a varying depth, a channel of the plurality of channels of the tertiary ring arranged to align with a portion of an opposing channel on the second surface of the primary ring.

12. A rotatable lock and release mechanism comprising:

a primary ring with a first surface and a second surface, wherein each surface of the primary ring includes a plurality of channels each having a varying depth;

a secondary ring with a first surface and a second surface, wherein the first surface of the secondary ring includes a plurality of channels each with a varying depth, the plurality of channels of the secondary ring arranged to align with a portion of an opposing channel of the plurality of channels of the primary ring;

a plurality of bearing balls arranged between the primary and secondary rings, each bearing ball partially arranged within a channel of the primary ring and partially arranged within an opposing channel of the secondary ring;

one or more retraction springs configured to bias the secondary ring toward the primary ring; and a latch to engage with the primary ring to secure the primary ring in the first position, the first position corresponding to the retraction springs being loaded against the secondary ring, wherein the latch is further configured to disengage with the primary ring allowing the primary ring to translate relative to the secondary ring from a first position, where each of the bearing balls is located along a respective channel at a first depth, to a second position, where each of the bearing balls is located along the respective channel at a second depth greater than the first depth, in response to the one or more retraction springs forcing the secondary ring towards the primary ring.

13. A mechanism to perform a guided position change comprising:

a primary plate with a first surface and a second surface, wherein each surface of the primary plate includes a plurality of channels each having a varying depth;

a secondary plate with a first surface and a second surface, wherein the first surface of the secondary plate includes a plurality of channels each with a varying depth, the plurality of channels of the secondary plate arranged to align with a portion of an opposing channel of the plurality of channels of the primary plate; and a plurality of low friction elements arranged between the primary and secondary plates, each low friction element partially arranged within a channel of the primary plate and partially arranged within an opposing channel of the secondary plate, wherein the primary plate is configured to translate relative to the secondary plate from a first position, where each of the low friction elements is located along a respective channel at a first depth, to a second position, where each of the low friction elements is located along the respective channel at a second depth greater than the first depth.

14. The mechanism of claim 13, wherein the arrangement of first and second depths within opposing channels is reversed, such that a first distance between the primary and secondary plates at the first position is greater than a second distance between the primary and secondary plates at the second position.

15. The mechanism of claim 13, wherein one or more of the plurality of low friction elements is a bearing ball, the second depth of the one or more channels corresponds to a depth up to a radius of the bearing ball.

16. The mechanism of claim 13, wherein each channel follows one of a generally linear path or a non-linear path.

17. The mechanism of claim 13, further comprising one or more retraction springs configured to bias the secondary plate toward the primary plate.

18. The mechanism of claim 17, further comprising a latch configured to:

engage with the primary plate to secure the primary plate in the first position, the first position corresponding to the retraction springs being loaded against the secondary plate; and disengage with the primary plate allowing the primary plate to translate from the first position to the second position in response to the one or more retraction springs forcing the secondary ring towards the primary plate.

* * * * *